US008091497B2

(12) United States Patent
Cook et al.

(10) Patent No.: US 8,091,497 B2
(45) Date of Patent: Jan. 10, 2012

(54) SECTIONALIZED MAST TRACK

(75) Inventors: Fred C. Cook, Assonet, MA (US); William H. Donaldson, Middletown, RI (US)

(73) Assignee: Schaefer Marine, Inc., New Bedford, MA (US)

( * ) Notice: Subject to any disclaimer, the term of this patent is extended or adjusted under 35 U.S.C. 154(b) by 277 days.

(21) Appl. No.: 12/437,062

(22) Filed: May 7, 2009

(65) Prior Publication Data

US 2010/0282154 A1 Nov. 11, 2010

(51) Int. Cl.
*B63H 9/08* (2006.01)
*B63H 9/10* (2006.01)

(52) U.S. Cl. ..... 114/112; 114/108; 114/204

(58) Field of Classification Search ..... 114/102.1, 114/102.12–102.19, 104–112, 204; 16/94 R, 16/95 R, 96 R
See application file for complete search history.

(56) References Cited

U.S. PATENT DOCUMENTS

| | | | | |
|---|---|---|---|---|
| 75,012 | A * | 3/1868 | Hart | 114/204 |
| 3,058,138 | A | 10/1962 | Tomlinson | |
| 3,331,348 | A | 7/1967 | Dyer | |
| 4,228,755 | A | 10/1980 | Graham | |
| 4,236,475 | A | 12/1980 | Merry | |
| 4,597,347 | A | 7/1986 | Spanopoulos | |
| 4,646,671 | A * | 3/1987 | Innes et al. | 114/102.14 |
| 4,821,664 | A | 4/1989 | Dahmen | |
| 5,127,351 | A | 7/1992 | Breems | |
| 5,305,700 | A | 4/1994 | Strong et al. | |
| 5,546,881 | A | 8/1996 | Frederiksen | |
| 5,562,063 | A * | 10/1996 | Graham | 114/105 |
| 5,697,314 | A | 12/1997 | Clausin | |
| 6,145,460 | A | 11/2000 | Brookes | |
| 6,371,037 | B1 | 4/2002 | Cook et al. | |
| 6,575,108 | B1 | 6/2003 | Lindström | |
| 8,001,916 | B2 | 8/2011 | Cook et al. | |

FOREIGN PATENT DOCUMENTS

| | | | |
|---|---|---|---|
| FR | 2621880 | A1 * | 4/1989 |
| FR | 2690893 | A1 * | 11/1993 |

OTHER PUBLICATIONS

Hasse, C., "A Mainsail for All Seasons," *Cruising World*, pp. 1-3, [online]. Sep. 2, 2002, [retrieved on Mar. 18, 2009]. Retrieved from the Internet URL:http://www.cruisingworld.com/article_print.jsp?ID=201148.

Hasse, C., "Cruising Sales: Mainsails," *Cruising Mainsails*, pp. 1-9, [online]. Apr. 30, 2004, [retrieved on Mar. 18, 2009]. Retrieved from the Internet URL:http://www.porttownsendsails.com/articles,htm.

* cited by examiner

*Primary Examiner* — Ajay Vasudeva
(74) *Attorney, Agent, or Firm* — Hamilton, Brook, Smith & Reynolds, P.C.

(57) ABSTRACT

Disclosed is a sectionalized mast track that solves problems associated with furling and reefing sails on yachts, particularly large yachts. The inventive mast track includes mast track sections that are secured to a mast with hinges. Securing pins connect the sections to each other such that all the sections pivot together along the centerline defined by hinges. The securing mechanisms also make it possible to remove a single mast track section at a time. Embodiments of the inventive mast track have a cross section that absorbs wind-generated compressive forces exerted by battens, reducing chafing, and eliminates the need for sail slides, which would otherwise lock the sail in place during furling and reefing. The inventive mast track may also be configured to couple to an articulating sail feeder that bends and rotates freely, but limits the axial twist of the sail as during furling and reefing.

26 Claims, 9 Drawing Sheets

SECTIONALIZED MAST TRACK

RELATED APPLICATIONS

This application is related to U.S. patent application Ser. No. 12/437,086, "Mega Yacht Mast Tracking System with Articulating Sail Feeder," filed May 7, 2009, now U.S. Pat. No. 8,001,916, and U.S. patent application Ser. No. 12/437,076, "Mast Track with External Headboard Car," also filed May 7, 2009 and currently pending. The subject matter of this application is also related to U.S. Pat. No. 6,371,037, "Sail Furling System," to Cook et al. filed on Dec. 26, 2000.

The above-referenced applications and patent are incorporated herein by reference in their entireties.

BACKGROUND OF THE INVENTION

Modern yachts have fore and aft sails, including a mainsail supported by a mast. The mainsail, which is triangular, is hitched at its bottom edge, or foot, to a boom that can swing about the lower part of the mast in either direction in relation to the longitudinal axis of the boat. The mainsail is raised or lowered by hoisting a halyard coupled to the upper corner, or head, of the mainsail. Raising the halyard causes the sail to extend such that the sail's forward edge, or luff, runs parallel to the mast.

Various track and slide assemblies have been used to guide the sail along the mast, making it easier to raise and lower the sail. These assemblies also link the aft edge of the mast to the sail luff. Typical assemblies include low-friction sail slides, attached to the luff at regular intervals, that fit onto a rail or into a track that extends along the longitudinal axis of the mast.

Prior art track and slide assemblies use tracks or rails that extend along the mast from the boom to the top of the mast. Some tracks and rails are attached to the mast, whereas others are integrally formed with the mast itself. Both integral and non-integral tracks and rails stiffen the mast. In addition, both integral and non-integral tracks and rails are difficult to maintain: if a sail slide becomes irretrievably jammed in the track, the entire track (or mast, for integral tracks) must be removed. Alternatively, the crew must go aloft to fix the problem in place. Both options are time-consuming for yachts with taller masts, and going aloft can be dangerous and impractical, depending on the conditions.

Conventional sail slides, which run in a channel or groove in a mast track, are attached to the mainsail with shackles or are sewn in position. Unfortunately, friction between the slides and the track causes the slides to lock in place, preventing the sail from being raised or lowered. For example, twisting or torquing forces by the mainsail exerted on rectangular slides bind the slides to the track, preventing sliding movement and making it impossible to control the mainsail. Pulling forces exerted on the slides by the mainsail may pull the slides from the track, depending on the design of the groove.

Ball track slides, which use plastic balls and a rail mounted on the mast to absorb loads except those in the direction of movement, do not suffer from friction locking. High loads flatten the balls, however, degrading the balls' bearing-like action. Ball track slide assemblies also weigh more than conventional assemblies and are more susceptible to jams due to corrosion and dirt. In addition, the rails for ball track slides tend to be much heavier than the tracks for conventional sail slides.

The linkage between the slides and the sail luff also affects the utility of the track and slide assembly. If the slides are rigidly coupled to reinforcements, or battens, attached to the luff of the sail, then wind pushing on the battens may cause the battens to push, in turn, on the slides, disrupting the link between the slides and the sail. These forces may also detach the slides from the track.

SUMMARY OF THE INVENTION

Embodiments of the present invention include a sectionalized mast track for a yacht and methods of raising and lowering a sail using a sectionalized mast track. The mast track may include plural mast track sections arranged in a column configured to be attached to a mast. Each section includes an upper receiver and a lower receiver oriented along the longitudinal axis of the column. Adjacent sections may be secured to each other with respective securing pins, each of which is configured to be received by a lower receiver of one mast track section and an upper receiver of an adjacent mast track section.

Certain embodiments of the mast track may include mast track sections that are configured to be individually detached from the mast. In addition, the inventive mast track may be configured allow the mast to bend and compress. The mast track may also be configured to allow for thermal expansion and contraction of the mast. Embodiments of the mast track are configured such that the mast track sections pivot together about a common centerline that runs parallel to the longitudinal axis of the mast.

Each mast track section may also include a beveled or round upper or lower surface, which may vary in angle depending on the location of particular mast track section along the mast. Adjacent mast track sections may also be separated by an interstitial space, which may differ for different pairs of adjacent mast track sections. In some embodiments, adjacent mast track sections at the top of the mast are separated by smaller interstitial spaces than adjacent mast track sections at the bottom of the mast.

Further embodiment mast tracks may include respective securing mechanisms to secure each securing pin. These securing mechanisms may be configured to secure the securing pin in both an extended position and a retracted position. Example securing mechanisms may include a slot that runs parallel to the lower receiver of a mast track section. The slot may be configured to receive a screw to secure the corresponding securing pin.

Still further embodiment mast tracks may include a channel configured to guide a headboard car along an axis substantially parallel to the longitudinal axis of the mast. In addition, mast tracks may have a cross section that forms a batten receptacle (also known as a luff extrusion). Example cross sections include a batten guide formed of two substantially parallel batten guide arms. A luff passage formed in a luff extrusion body connects the batten guide to a luff rope slot also formed in the luff extrusion body. The luff rope slot may be substantially parallel to a longitudinal axis of the mast.

Yet further embodiment mast tracks may be configured to be coupled to an articulating sail feeder. Example articulating sail feeders include binge tracks arranged in an articulating column with a longitudinal axis substantially parallel to a mast of a yacht, where the hinge tracks are configured to receive a sail luff. Limiting pins and ball joints in the articulating column enables lateral and rotational movement of the sail. The limiting pins, which are disposed between respective pairs of adjacent hinge tracks, limit the movement of a given hinge track with respect to a neighboring hinge track. The ball joints, which are also disposed between respective pairs of adjacent hinge tracks, receive a tensioning line that runs along the longitudinal axis of the articulating column.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
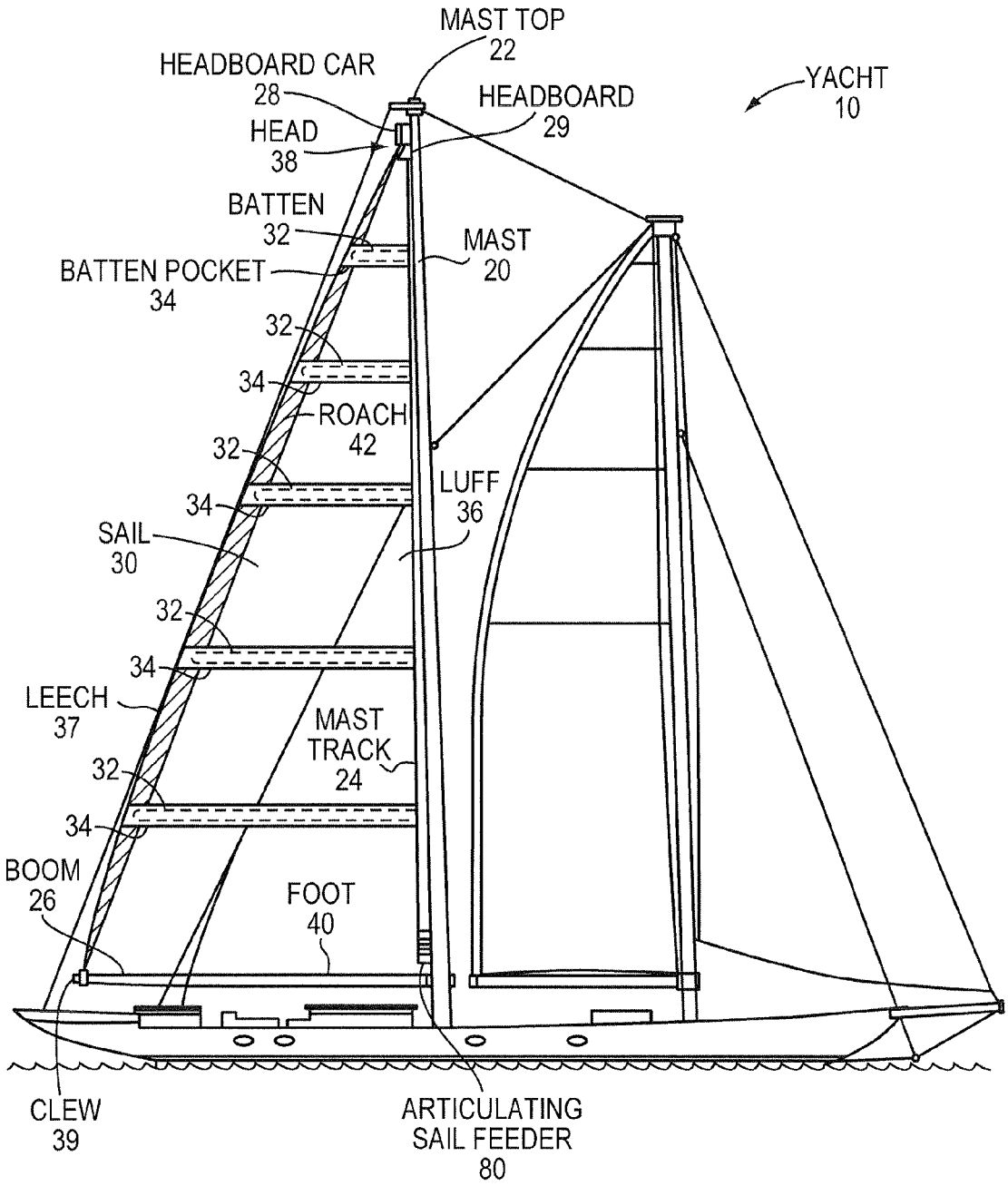
FIG. 1 is an elevation view of a yacht employing an example sectionalized mast track of the present invention.

FIG. 1 shows a yacht 10 with a mast 20 and a boom 26. The boom 26 stores a sail 30, which may be raised with a halyard (not shown) and a headboard ear 28 to capture wind and propel the yacht 10. The headboard car 28 is coupled to a headboard 29 that reinforces the head 38 of the sail 30 to prevent high loads from tearing apart the head 38. A mast track 24 guides the headboard car 28 and a luff rope (not shown; also known as a sail bolt rope or bolt rope) stitched into the forward edge, or luff 36, of the sail 30 along an axis parallel to the long axis of the mast 20. Although the headboard car 28 shown in FIG. 1 travels along a channel on the outside of the mast track 24, alternative headboard cars may be configured to travel within a groove internal to the mast track 24.

The sail 30 shown in FIG. 1 is a fully battened mainsail 30 with battens 32 that run generally parallel to the bottom edge, or foot 40, of the sail 30 from the luff 36 (leading edge) to the trailing edge, or leech 37, of the sail 30. The battens 32 are stitched into batten pockets 34 in the sail 30. Standard battens (not shown) run only partway from the luff 36 to the leech 37, trading long-term performance for reduced chafing and easier handling. Battens may be oriented in other directions or combinations of directions; for example, alternative battens may run perpendicularly from the leech 37 to intersect the foot 40 and the luff 36 at substantially complementary angles.

Full battens 32 support roach 42, the sail area that lies outside a straight line from the head 38 to the lower aft corner, or clew 39, of the sail 30. Typically, the supporting battens 32 are about three times longer than the roach 42 that they support. Roach 42 enhances sail performance by adding 15-30% more sail area to a triangular sail, such as the sail 30 shown in FIG. 1. More importantly, mainsails with roach 42 have elliptically shaped heads and planforms that improve performance on all points of sail, particularly to weather.

Unfortunately, full-length battens 32 reduce the life of the sail 30 by chafing against the batten pockets 34 and/or the sail bolt rope (not shown), which is sewn into the edge of the sail 30 to prevent fraying. The same forces that pull the sail 30 taut to propel the yacht 10 push the battens 32 towards the mast 20, causing the battens 32 to chafe against the batten pockets 34. Eventually, this chafing causes the battens 32 to tear or fray the sail bolt rope and to poke through the forward ends of the batten pockets 34. Reinforcing the batten pockets 34 alleviates this problem on vessels with smaller sails, but reinforcement is not sufficient to withstand chafing due to the larger compressive forces exerted on battens 32 in larger sails. In addition, compression increases friction on the sail slides that run in conventional mast tracks, making it difficult to raise, lower, or reef the sail 30.

An articulating sail feeder 80 coupled to the bottom of the mast track 24 limits the sail's range of motion as the sail 30 is fed into the boom 26 by a boom furler (not shown), making it easier to reef and furl the sail 30. In yachts 10 without the present inventive articulating sail feeder 80, the sail 30 deforms in the space above the boom 26 during winding, causing folds in the ends of the winding. The articulating sail feeder 80 moves with the sail 30 as the sail 30 is being furled or reefed, preventing deformation and relieving stress on the sail bolt rope. The articulating sail feeder 80 allows the sail 30 to move and rotate freely from side to side (i.e., laterally), while preventing the sail from twisting too much around an axis parallel to the long axis of the mast 20.

Figure 2:
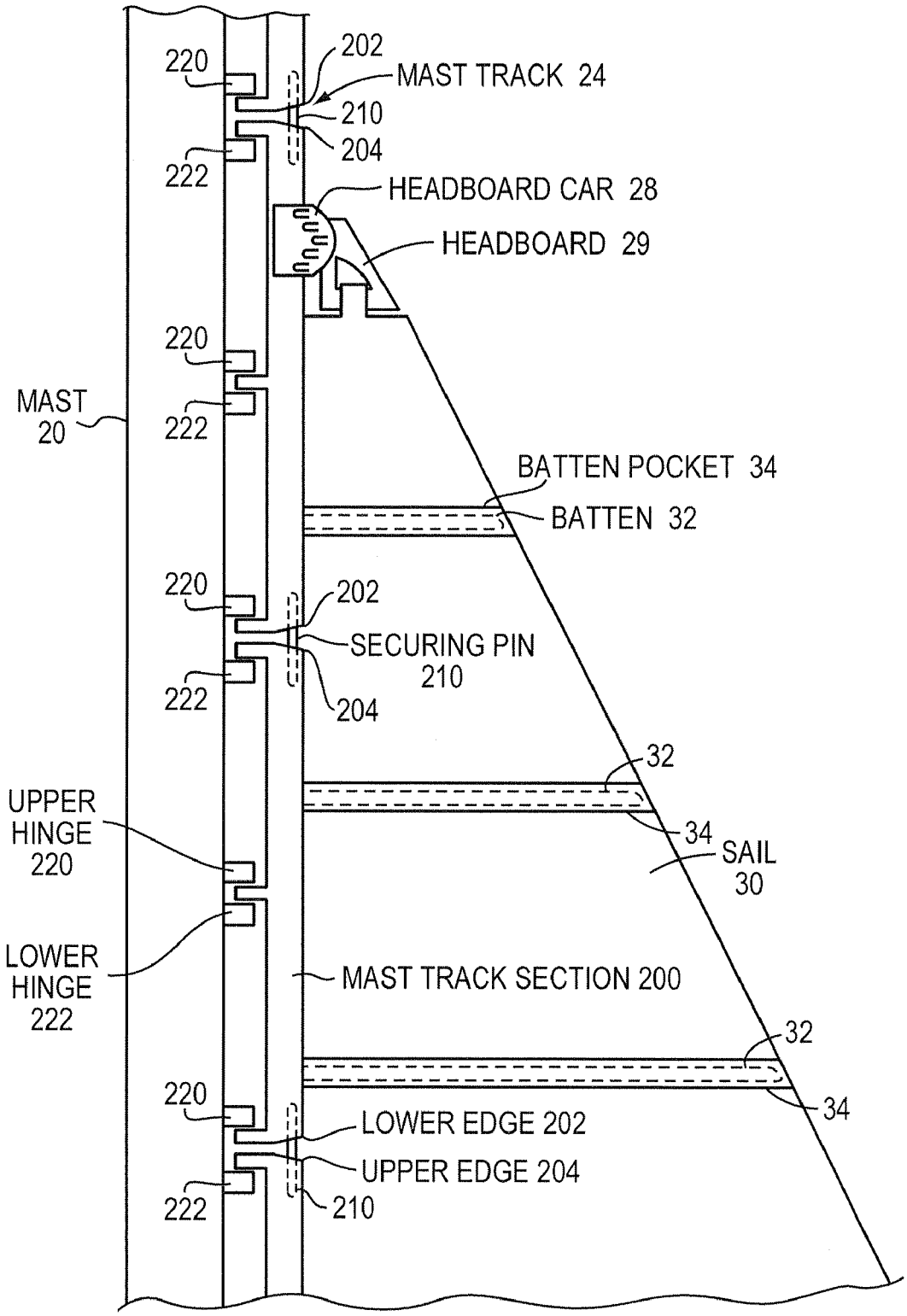
FIG. 2 is an elevation view of part of a mast, sail, and example sectionalized mast track of the present invention.

FIG. 2 is an elevation view of a mast 20, sail 30, and mast track 24 according to embodiments of the present invention. The mast track 24 includes multiple mast track sections 200 coupled to the mast 20 with upper hinges 220 and lower hinges 222. The mast track sections 200 are coupled to each other with securing pins 210 that can be locked in place. Unlocking the securing pins 210 makes it possible to remove or replace an individual mast track section 200 without removing the entire mast track 24. This feature is particularly useful on large yachts, which may have mast tracks 24 that extend for tens of meters.

Because the securing pins 210 fix the mast track sections 200 to each other, the mast track sections 200 pivot together along a common centerline defined by the upper and lower hinges 220, 222. This centerline runs parallel to and just aft of the longitudinal axis of the mast 20. The mast track sections 200, hinges 220 and 222, and securing pins 210 are typically machined to ensure tight enough tolerances so that they fit together well and pivot smoothly.

The inventive mast track 24 also withstand the bending and compressing forces exerted on the mast by the sail 30. For example, hoisting the sail 30 increases the weight aloft, compressing the mast 20 and the mast track 24. For large yachts, the compression can be as great as 1 mm/m. Spaces between neighboring mast track sections 200 offset the effects of this compression. Because compression increases towards the bottom of the mast 20 and mast track sections 200, the amount of space between adjacent mast track sections 200 may depend on the location of the mast track sections 200. For instance, mast track sections 200 at the bottom of the mast 20 may be separated by larger distances than the sections 200 at the top of the mast 20.

Other forces may cause the mast 20 and mast track 24 to bend. These forces include the weight of the sail 30, forces exerted by wind, and, for masts 20 and mast tracks 24 made of different materials, expansion and compression forces due to mismatched coefficients of thermal expansion. Beveling or rounding off the upper and lower edges 204 and 202, respectively, of each mast track section 200 allows the mast track 24 to bend more easily. Each mast track section 200 may be beveled or rounded to a degree that depends on the mast track section's 200 location on the mast 20.

Figure 3:
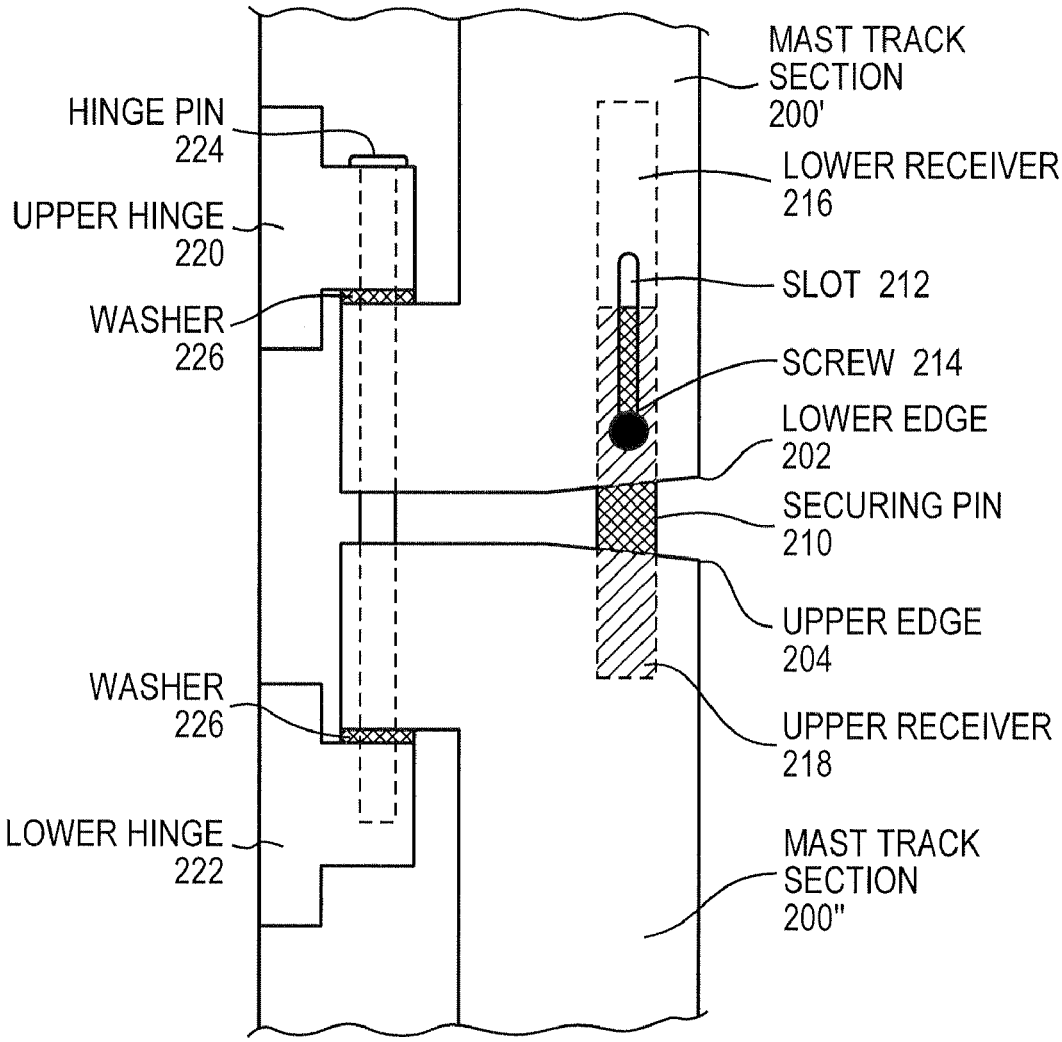
FIG. 3 is an elevation view of a securing mechanism used to couple adjacent mast track sections according to embodiments of the present invention.

FIG. 3 is a plan view of the connection between adjacent mast track sections 200' and 200". The upper mast track section 200' is coupled to the mast 20 with a hinge pin 224 that fixes the mast track section 200' to an upper hinge 220, shown in greater detail in FIG. 4A. A washer 226 separates the hinge 220 from the section 200', allowing the section 200' to pivot about the longitudinal axis of the hinge pin 224. The lower mast track section 200" is similarly connected to a lower hinge 222, shown in greater detail in FIG. 4B, with the hinge pin 224. Alternatively, the sections 200' and 200" may be connected to the upper and lower hinges 220 and 222 with separate upper and lower hinge pins, respectively.

The mast track sections 200' and 200" are connected to each other with a securing pin 210 that fits into an upper receiver 218 in the lower mast track section 200" and a lower receiver 216 in the upper mast track section 200'. The securing pin 210 is fixed in place with a screw 214 that fits into a slot 212 along the lower receiver 216. The securing pin 210 can be retracted into the lower receiver 216 by loosening the screw 214, pushing the securing pin 210 up, then tightening the screw 214. Retracting the securing pin 210 and removing the hinge pin 224 makes it possible to remove a single mast track section (e.g., section 200') at a time without having to remove the entire mast track 24. When separate upper and lower hinge pins are used, only one of the upper and lower hinge pins may need to be removed to remove the mast track section.

Typically, the lower receiver 216 is long enough to accommodate the entire securing pin 210, allowing the securing pin 210 to be stowed so that one of the mast track sections 200 may be removed from the mast 20. The upper receiver 218, on the other hand, is usually not configured to receive the entire securing pin 210 in order to prevent the pin 210 from becoming stuck in the upper receiver 218. For example, the securing pin 210 may be five inches long, the lower receiver 216 may be five inches high, and the upper receiver 218 may be two and a half inches high. Those skilled in the art will appreciate that this is one of many suitable ways to secure adjacent mast track sections 200 to each other.

Mast tracks 24 with the inventive luff extrusion cross section 300 may be fabricated of carbon fiber, 6005 aluminum alloy, or any other suitable material. Generally, suitable materials are at least moderately strong; capable of bending, flexing and twisting; suitable for machining, welding, and brazing; and corrosion resistant (or able to be treated or coated with corrosion-resistant material). Mast tracks 24 may be made by machining, extrusion, or any other suitable manufacturing techniques. The height of each mast track section 200 depends on the height of the mast 20 and the number of sections 200 desired.

Figure 4A:
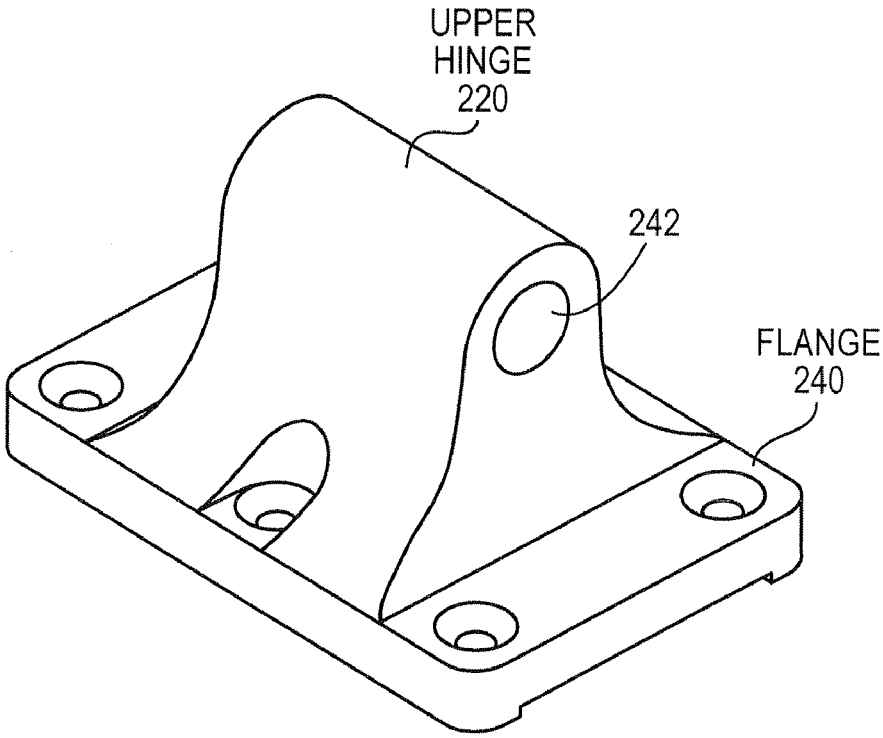
FIGS. 4A and 4B are perspective views of upper and lower hinges, respectively, used in embodiments of the present invention.
Figure 4B:
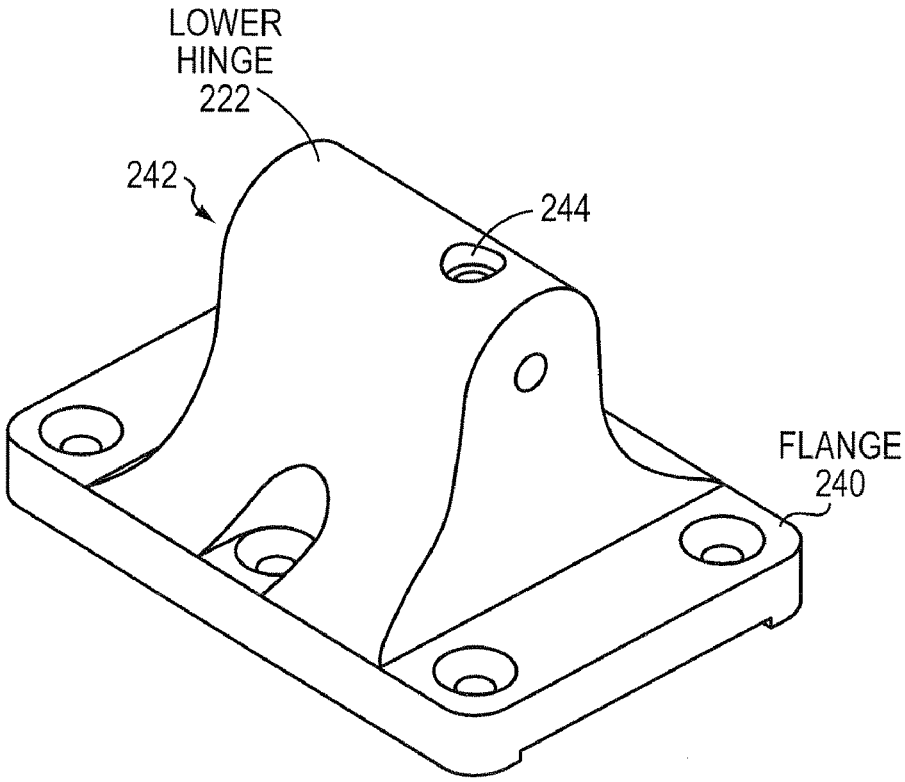

FIGS. 4A and 4B are perspective views of the upper and lower hinges 220 and 222, respectively. Each hinge 220, 222 includes a flange 240 for connecting the hinge 220, 222 to the mast 20 and hole 242 for a hinge pin 224 (FIG. 3). The holes 242 may be blind holes or through holes. The hinges 220, 222 may also include holes 244 for set screws or pins for securing the hinge pins 224. Hinges 220, 222 may be made of aluminum or any other suitably light, strong material capable of withstanding corrosion.

Figure 5:
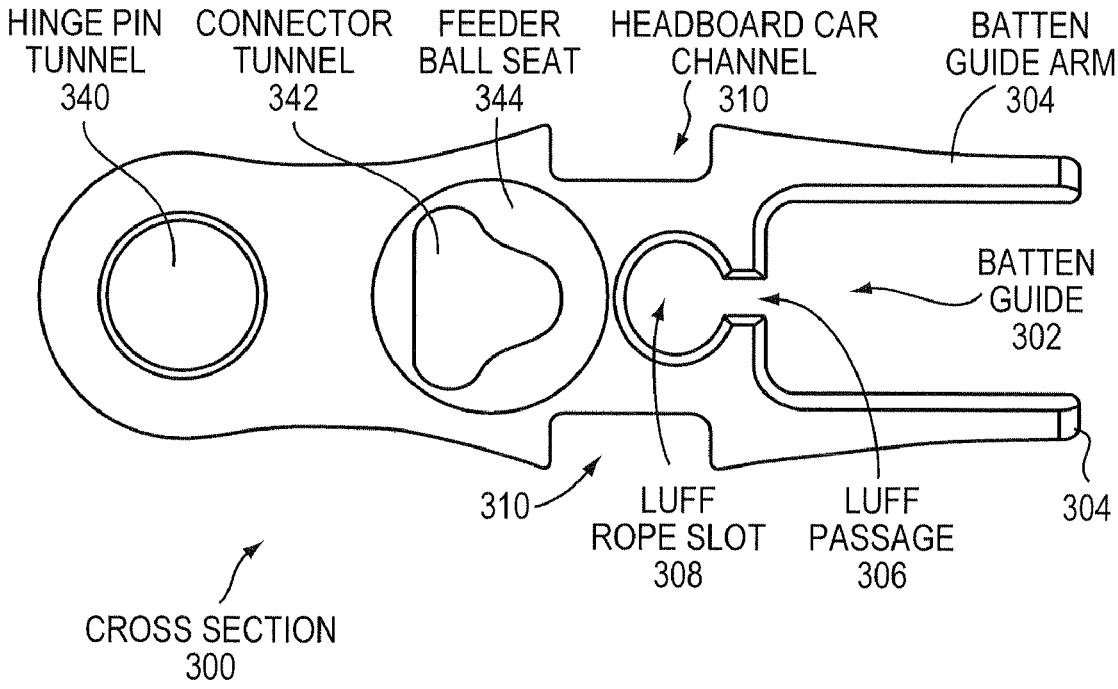
FIG. 5 is a plan view of a mast track cross section according to embodiments of the present invention.

FIG. 5 is a plan view of a mast track cross section, or luff extrusion 300, suitable for use with an external headboard car 28. The Tuff extrusion 300 solves the problem of batten poke or chafing by providing a batten guide 302 that receives battens along the length of the mast track 24, such as the full battens 32 shown in FIGS. 1 and 2. Unlike the batten receptacles disclosed in U.S. Pat. No. 6,371,037 to Cook et al., the present inventive luff extrusion 300 also eliminates problems associated with friction-locked sail slides by providing a channel 310 for a headboard car 28 (FIG. 1) that disposes with the need for sail slides.

The luff extrusion 300 includes a pair of substantially parallel batten guide arms 304 that form the batten guide 302. A luff passage 306 connects the batten guide 302 to a luff rope slot 308 configured to hold a luff rope sewn into the luff 36 of a sail 30. As wind fills the sail 30, compressing the battens 32 (FIG. 1), the battens 32 push against the forward edge of the batten guide 302, reducing chafing on the batten pockets 34 (FIG. 1). The batten guide arms 304 also stabilize battens 32 subject to rotational forces, such as those shown in FIG. 2C.

As shown in FIG. 5, the headboard car channel 310 is formed substantially next to (i.e., abeam of) the luff rope slot 308, defining a travel axis for the headboard car 28 (FIG. 1) that is substantially coincident with the axis formed by the luff rope slot 308. Because the headboard car 28 and the luff rope (not shown) travel along the same axis, torque on the headboard car 28 or the headboard 29 (FIG. 1) in the plane of the sail 30 is less likely to cause the headboard car 28 to shift, jam, or stick in the headboard car channel 310. As a result, the luff rope and headboard car 28 travels freely up and down an axis parallel to the longitudinal axis of the mast 20.

The luff extrusion 300 may also include a hinge pin tunnel 340, a connector tunnel 342, and a feeder ball seat 344. The hinge pin tunnel 340 can be used to hold hinge pins 224 (FIG. 3) that connect the mast track 24 to hinges 220 and 222 (FIGS. 2, 3, 4A and 4B) on the mast 20. The hinges 220, 222 and hinge pins 224 allow the mast track 24 to pivot about the longitudinal axis of the mast 20. Similarly, the connector tunnel 342 can be used to connect mast track sections 200 to each other so that all the sections 200 pivot on one centerline.

In a preferred embodiment, the luff extrusion 300 is almost six inches long and varies in width from just under two inches just forward of the headboard car channel 28 to about one and a quarter inches at the channel 28 itself. The headboard car channels 310 are each just under one inch wide and about one-quarter inch deep. The batten arms 304 are about one and three-quarter inches long, forming a batten guide 302 with a length of one and three-quarter inches and a width of about one inch. The luff passage 306 may be about one-fifth inch wide and about one-quarter inch long; the luff rope slot 308 can be about three-eighths inch in radius. Edges of mast tracks 24 with the present inventive luff extrusion cross section 300 may be beveled, chamfered, and/or radiused as appropriate. For example, the upper and lower faces of the mast track sections 200 may be beveled at an angle of 1.5° from the forward edge of the channel 310 to the after edge of the batten guide arms 304. In addition, the headboard car channels 310 may be beveled or flared at one or both ends of each mast track section 200 to more easily receive the headboard car 28.

Figure 6A:
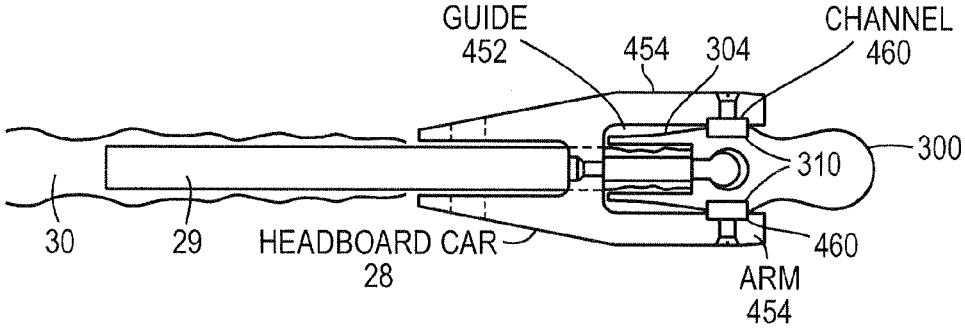
FIGS. 6A and 6B are plan and elevation views, respectively, of a sail, external headboard car, and headboard suitable for use with an example inventive mast track.
Figure 6B:
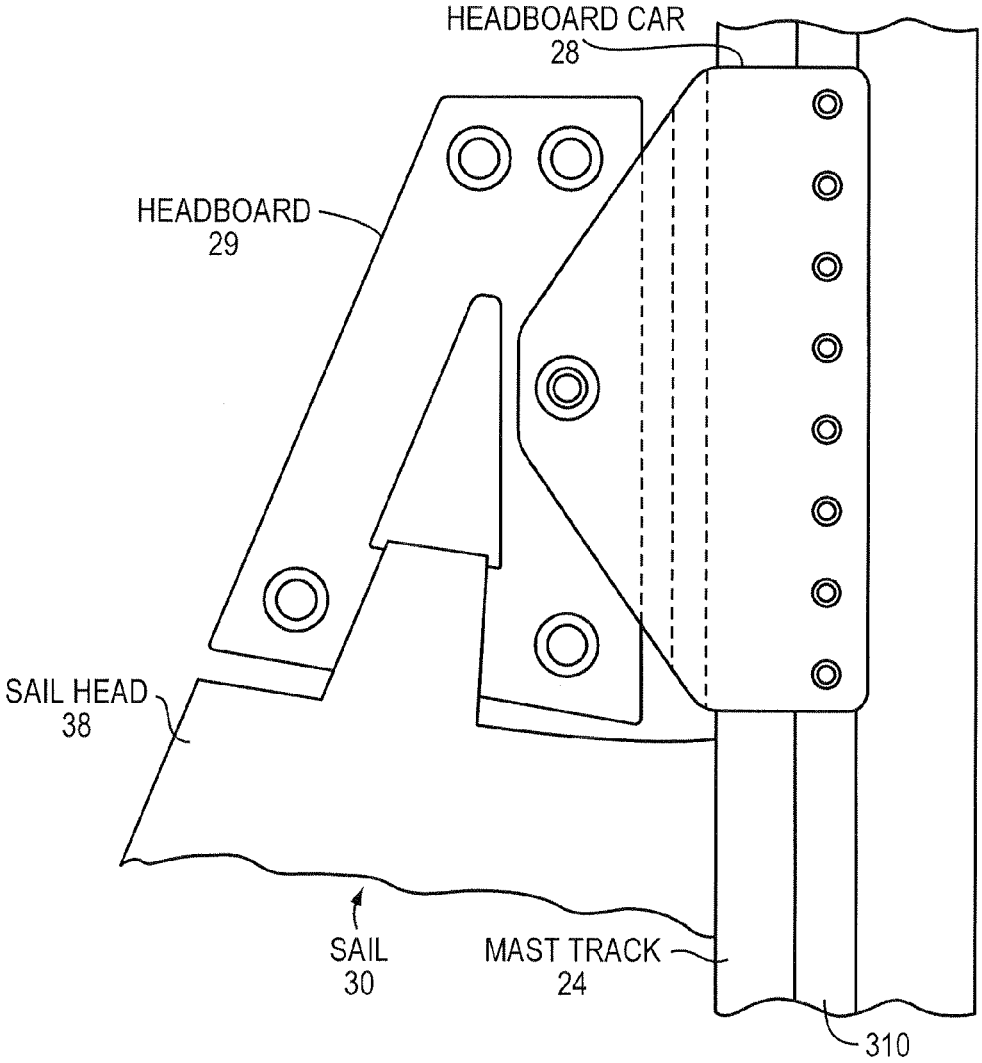

FIGS. 6A and 6B are, respectively, plan and elevation views of a sail 30, headboard car 28, and mast track 24 with the present inventive luff extrusion cross section 300. The headboard car 28, which is coupled to the head 38 of a sail 30 via the headboard 29, includes a guide 452 formed of two substantially parallel arms 454 that fit around the outside of the luff extrusion 300. The arms 454 on the headboard car 28 have channels 460 that mate with the complementary channels 310 on the luff extrusion 300. Bearings (not shown) between the channels 310 on the luff extrusion 300 and the channels 460 on the headboard car 28 allow the headboard car 28 to travel freely along an axis substantially parallel to the mast 20.

Because the headboard car 28 travels smoothly along the bearings between the channels 460 and 310, the sail 30 can be raised and lowered with a halyard (not shown) attached to the headboard car 28. In contrast to conventional sails, which are raised with halyards attached directly to the head 38 or the headboard 29, sails 30 coupled to headboard cars 28 in embodiments of the present invention do not need sail slides to ensure smooth travel of the sail up and down the mast. As a result, sails 30 raised with headboard cars 28 configured with luff extrusions 300 of the present invention do not suffer from the compression- and torque-induced friction that locks sail slides into place.

In a preferred embodiment, the headboard car 28 is made of aluminum or any other suitably strong, light, and corrosion-resistant material. The guide 452 is wide enough and long enough to substantially accommodate the luff extrusion 300. For example, the arms 454 may be about five inches long and spaced about two inches apart. The edges of the headboard car 28 may be beveled, chamfered, and/or radiused as appropriate.

Figure 7:
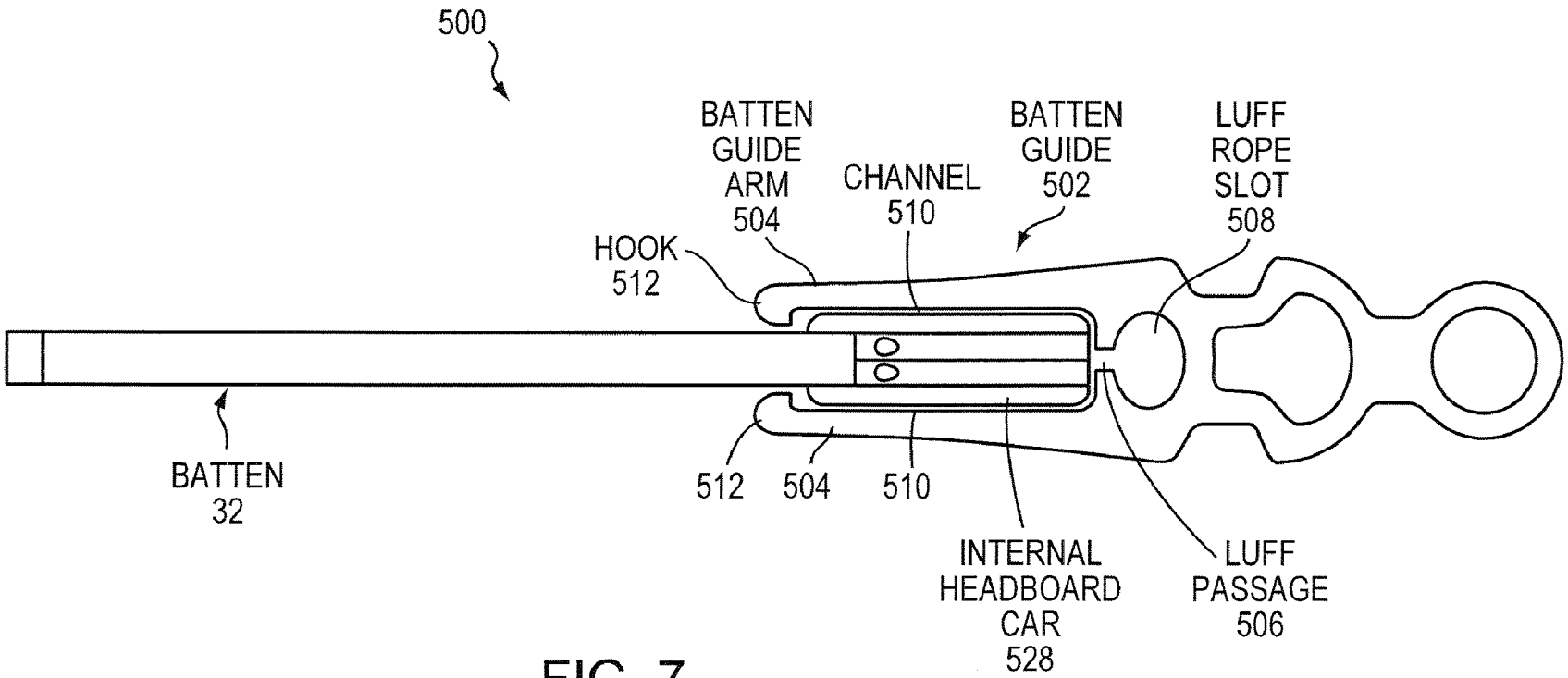
FIG. 7 is a plan view of a mast track cross section suitable for use with an internal headboard car according to alternative embodiments of the present invention.

FIG. 7 is a plan view of an alternative mast track cross section 500 with an internal headboard car 528. The cross section 500 includes a pair of substantially parallel batten guide arms 504 that form a batten guide 502, which connects to a luff rope slot 508 via a luff passage 506. Each batten guide arm 504 terminates in a hook shape 512 or similar configuration that defines a headboard car channel 510 inside the batten guide 502. The internal headboard ear 528, which may be round or disc-shaped (i.e., shaped like a hockey puck), travels in the space defined by the batten guide 502 along an axis defined by the headboard car channel 510. The hooks 512 retain the headboard car 528 within the batten guide 502.

The batten guide 502 receives battens 32 sewn in the sail below the headboard car 528. As compressive forces push the battens 32 forward, the battens 32 push against the batten guide 502, rather than chafing against the forward edges of the sail bolt rope. Similarly, the batten guide arms 504 hold the battens 32 as the battens 32 twist and rotate, reducing friction between the battens 32 and the respective batten pockets 34.

The alternative cross section 500 also includes a connector tunnel 542 and a hinge pin tunnel 540, which are configured to retain a tensioning line 86 and limiting pins 90, respectively. The connector 542 may also be configured to receive ball joints 94 with a ball joint seat (not shown).

Of course, other configurations of headboard car channels are possible. For example, the headboard car 28 could ride on channels formed by everted channels, protrusions, or rails that stick out from a mast track 24 with the inventive luff extrusion cross section. The channels may include more than two channels on each side, or may be formed further forward or aft along the inventive luff extrusion. The channels may be integral to the cross section or may formed by fixing additional parts to the mast 20 or mast track 24.

Figure 8:
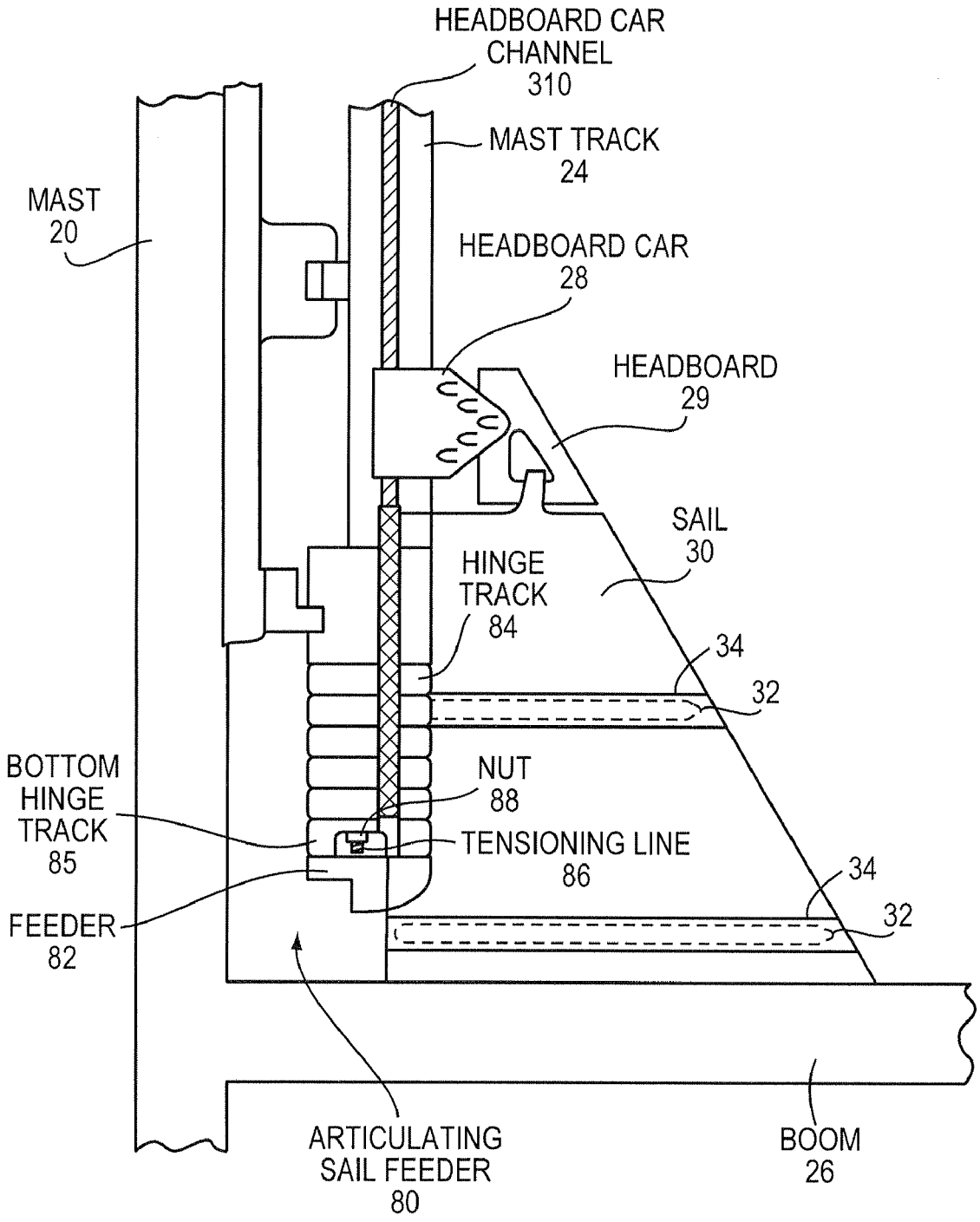
FIG. 8 is an elevation view of a mast, sail, and articulating sail feeder suitable for use with embodiments of the present invention.

FIG. 8 shows an example articulating sail feeder 80 coupled to the bottom of a mast track 24. The lower end of the articulating sail feeder 80 is suspended from the mast 20 above the boom 26 to allow free lateral movement of the sail 30 as the sail 30 is raised or lowered using the headboard car 28 coupled to the headboard 29. The articulating sail feeder 80 flexes and twists as the sail 30 is wound down, reducing deformation of the sail 30 and eliminating folds in the ends of the winding. The articulating sail feeder 80 also reduces stress on the bolt rope by flexing and bending, making it easier to wind or unwind the sail 30. In addition, the articulating sail feeder 80 may be configured to enable limited twist or rotation about an axis parallel to the longitudinal axis of the mast 20 as the sail 30 is furled or reefed. The articulating sail feeder 80 may also flex fore and aft (i.e., in the plane of the page) or abeam (i.e., into and out of the page).

A feeder 82 at the bottom of the articulating sail feeder 80 guides the sail 30 into and out of the articulating sail feeder 80, which includes several hinge tracks 84 arranged in a column between the feeder 82 and the bottom edge of the mast track 24. A threaded tensioning line 86 runs through the hinge tracks 84 along the interior of the column. A nut 88 secures the lower end of the tensioning line 86 in a bottom hinge track 85. Adjusting the nut 88 changes the tension of the tensioning line 86, altering the articulating sail feeder's range of motion. Alternatively, the tension of the tensioning line 86 can be adjusted with a hydraulic or pneumatic cylinder.

Figure 9A:
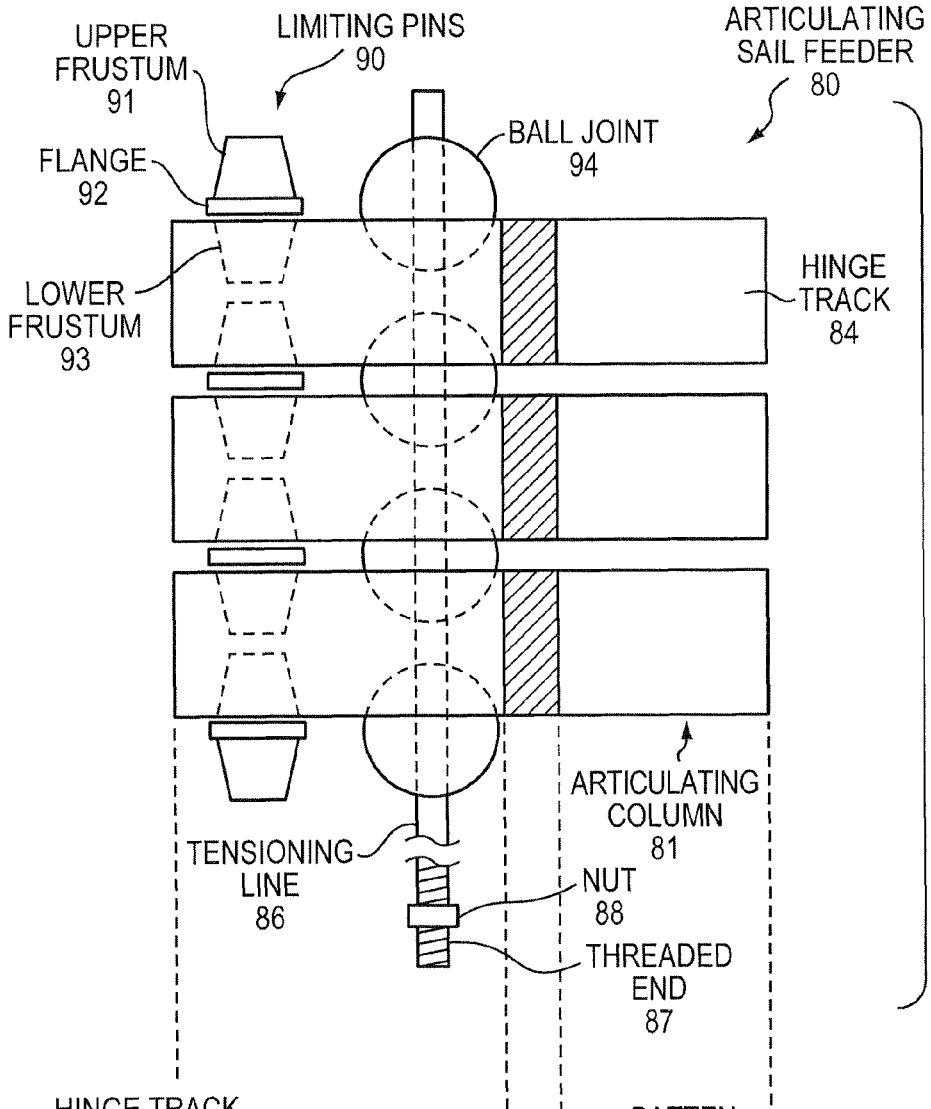
FIGS. 9A and 9B are, respectively, an elevation view of an example articulating sail feeder and a plan view of a hinge track of the example articulating sail feeder in the present invention.
Figure 9B:
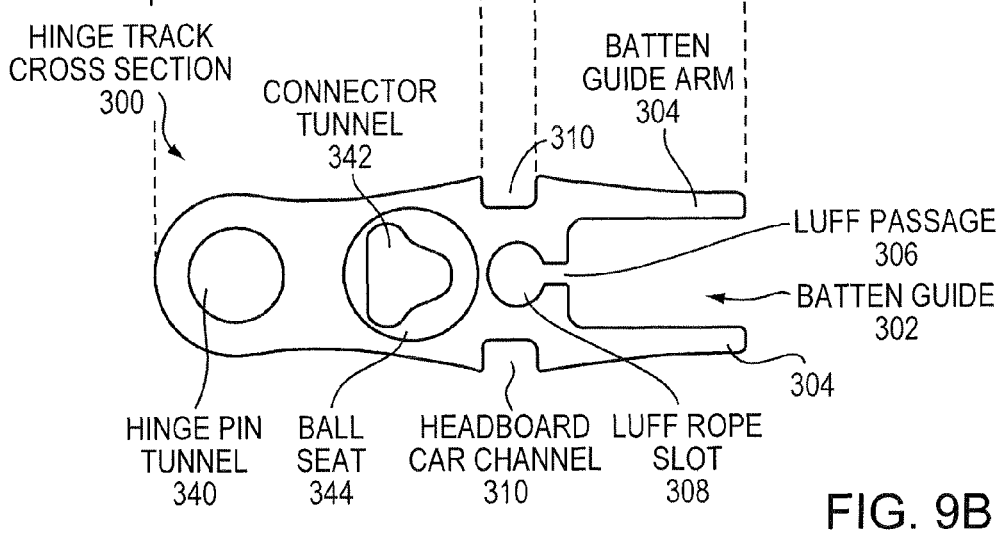

FIGS. 9A and 9B are elevation and plan views, respectively, of the articulating sail feeder 80 and some of its components, including hinge tracks 84, limiting pins 90, and ball joints 94. The articulating sail feeder 80 includes plural hinge tracks 84 arranged in an articulating column 81 like vertebrae in a spine. Limiting pins 90 and balls joints 94 arranged between respective pairs of adjacent hinge tracks 84 limit the motion of the column 81.

As shown in FIG. 9A, each limiting pin 90 is formed of upper and lower truncated conical sections, or frustums 91 and 93, attached to a flange 92. The flange 92 separates a respective pair of neighboring hinge tracks 84, which receive the upper and lower frustums 91 and 93 in respective recesses 340. In a preferred embodiment, the limiting pins 90 are formed of nylon that has a low coefficient of thermal expansion, high strength, and high rigidity, such as Nylatron GS. Typically, the edges of the limiting pins 90 are beveled or radiused and the pins 90 themselves are deburred.

The cone angle of the sides of the frustums 91 and 93 fixes the maximum bend angle between adjacent pairs of hinge tracks 84, preventing the articulating column 81 from bending too much in one direction or another. Because the limiting pins 90 are symmetric about the longitudinal axis of the column 81, they permit universal axial motion (i.e., rotation) about the longitudinal axis of the column 81.

Each ball joint 94 is disposed between a respective pair of neighboring hinge tracks 84 in seats 344 aft of the limiting pin recesses 340 and forward of batten guides 302 shown in FIG. 9B. The ball joints 94 receive a tensioning line 86 that runs through the column 81 via holes along the diameters of the ball joints 94. Like the limiting pins 90, the ball joints 94 may be formed of nylon that has a low coefficient of thermal expansion, high strength, and high rigidity, such as Nylatron GS. Typically, the edges of the ball joints 94 are beveled or radiused and the ball joints 94 themselves are deburred.

The tensioning line 86 may be a flexible wire, cable, rod, synthetic rope, or any other suitable line or cable. As shown in FIG. 9A, the tensioning line 86 includes a threaded end 87 that receives a nut 88. Increasing the tension on the tensioning line 86 by tightening the nut 88 presses (vertically compresses) the hinge tracks 84 together, reducing the column's range of motion. Conversely, reducing the tension on the tensioning line 86 by loosening the nut 88 relieves pressures on the hinge tracks 84, increasing the column's range of motion. Other embodiments may includes other tensioning means such as hydraulic or pneumatic cylinders arranged at the upper end, lower end, or both ends of the tensioning line 86.

FIG. 9B shows the cross section 300 of the hinge of a hinge track 84; this cross section 300 is also known as a luff extrusion. A hinge track 84 with the luff extrusion cross section 300 shown in FIG. 9B solves the problem of batten poke or chafing by providing a batten guide 302 that receives battens along the length of the mast 20, such as the full battens 32 shown in FIG. 1. The present inventive hinge track cross section 300 also eliminates problems associated with friction-locked sail slides by providing a channel 310 for a headboard car 28 that eliminates the need for sail slides. As described above with respect to the mast track sections 200, the upper and lower surfaces of the batten guide arms 304 may be beveled (e.g., by 2.5°) to allow the articulating column 81 to bend and flex along the plane of the sail 30.

The cross section 300 also includes a hinge pin tunnel 340 configured to receive limiting pins 90 and a ball seat 344 configured to receive ball joints 94. Each hinge track 84 has a connector tunnel 342 that connects the upper and lower ball seats 344, as shown in FIG. 6C. The tunnels 340 and 342 may extend through the entire thickness of the hinge track 84 with a constant shape and size. Alternatively, they may be configured to have upper and lower receptacles to prevent neighboring limiting pins 90 and ball joints 94 from touching each other.

In a preferred embodiment, the hinge tracks 84 are each about five and a half inches long, about two inches high, and vary in width from just under two inches just forward of the headboard car channel 28 to about one and a quarter inches at the channel 28 itself. The headboard car channels 310 are each about seven-eighths of an inch wide and about one-quarter inch deep. The batten guide arms 304 are just under one and three-quarters inch long, forming a batten guide 302 of same length and a width of about one inch. The luff passage 306 may be about one-fifth of an inch wide and about one-quarter of an inch long. The luff rope slot 308 has a radius of about three-tenths of an inch. Edges of hinge tracks 84 with the present inventive luff extrusion cross section 300 may be beveled, chamfered, and/or radiused as appropriate.

While this invention has been particularly shown and described with references to example embodiments thereof, it will be understood by those skilled in the art that various changes in form and details may be made therein without departing from the scope of the invention encompassed by the appended claims.

For example, the generic term yacht as used herein includes sailing vessels, boats, and ships of various sizes, including mega-yachts, which may be 40 feet or longer. Similarly, the generic term sail includes mainsails, which are used primarily to propel yachts. Likewise, the generic term mast includes mainmasts and other masts. In addition, the terms luff rope, sail bolt rope, and bolt rope may be used interchangeably.

Further, the various dimensions, materials, and surface or edge processing are for purposes of non-limiting illustration. Other dimensions, materials, and manufacturing processing are suitable.

What is claimed is:

1. A mast track for raising or lowering a sail on a yacht, the mast track comprising:

plural mast track sections arranged in a column, the column being configured to be attached to a mast for guiding a sail along the mast, each section comprising an upper receiver and a lower receiver oriented along the longitudinal axis of the column;

a respective securing pin for each pair of adjacent said mast track sections, each securing pin arranged to be received by a lower receiver of one mast track section and an upper receiver of an adjacent mast track section;

a respective securing mechanism in each mast track section for securing each securing pin, each securing mechanism being configured to secure a respective securing pin in both an extended position and a retracted position, wherein each securing mechanism includes a slot and a screw, the slot running parallel to the lower receiver of each mast track section, and the screw being received in the slot to secure a respective securing pin in one of the extended and retracted positions; and a channel extending along the longitudinal axis of the column, the channel configured to guide a headboard car along an axis substantially parallel to the longitudinal axis of the mast.

2. The mast track as claimed in claim 1 wherein each mast track section is configured to be individually detached from the mast.

3. The mast track as claimed in claim 1 wherein the mast track is configured to allow the mast to bend.

4. The mast track as claimed in claim 1 wherein each mast track section includes a beveled lower surface.

5. The mast track as claimed in claim 1 wherein the mast track sections are configured to allow longitudinal compression of the mast.

6. The mast track as claimed in claim 1 wherein adjacent mast track sections are separated by an interstitial space.

7. The mast track as claimed in claim 6 wherein adjacent mast track sections at the top of the mast are separated by smaller interstitial spaces than adjacent mast track sections at the bottom of the mast.

8. The mast track as claimed in claim 1 wherein the mast track is configured to allow for thermal expansion and contraction of the mast.

9. The mast track as claimed in claim 1 wherein the mast track sections are configured to pivot together along a common centerline parallel to the longitudinal axis of the mast.

10. claim 1 wherein said channel further comprises a headboard car configured for sliding along an axis substantially parallel to the longitudinal axis of the mast.

11. The mast track as claimed in claim 1 having a cross section comprising:

a batten guide formed of two substantially parallel batten guide arms;

a luff extrusion body having a luff rope slot formed forward of the batten guide, the luff rope slot being substantially parallel to a longitudinal axis of the mast; and a luff passage connecting the batten guide and the luff rope slot.

12. The mast track as claimed in claim 1 wherein the mast track is configured to coupled to an articulating sail feeder.

13. The mast track as claimed in claim 1 wherein the mast track is configured to be coupled to an articulating sail feeder, the articulating sail feeder comprising:

hinge tracks arranged in an articulated column with a longitudinal axis substantially parallel to a mast of a yacht, the hinge tracks configured to receive a luff of a sail, and the articulated column enabling lateral and rotational movement of a sail of the yacht;

limiting pins, each limiting pin disposed between a respective pair of adjacent hinge tracks, the limiting pins configured to limit movement of a given hinge track with respect to neighboring hinge track; and plural ball joints, each ball joint disposed between a respective pair of hinge adjacent tracks, the ball joints configured to receive a compression rod running through ball joints along the longitudinal axis of the articulated column.

14. A method of raising and lowering a sail of a yacht, the method comprising:

employing a mast track comprising plural mast track sections arranged in a column, the column being configured to be attached to a mast for guiding a sail along the mast, each section comprising an upper receiver and a lower receiver oriented along the longitudinal axis of the column;

securing adjacent said mast track sections with respective securing pins, each securing pin arranged to be received by a lower receiver of one mast track section and an upper receiver of an adjacent mast track section;

providing respective securing mechanism in each mast track section for securing each securing pin, each securing mechanism being configured to secure a respective securing pin in both an extended position and a retracted position, wherein each securing mechanism includes a slot and a screw, the slot running parallel to the lower receiver of each mast track section, and the screw being received in the slot to secure a respective securing pin in one of the extended and retracted positions; and employing a channel extending along the longitudinal axis of the column, the channel configured to guide a headboard car along an axis substantially parallel to the longitudinal axis of the mast.

15. The method as claimed in claim 14 wherein each mast track section is configured to be individually detached from the mast.

16. The method as claimed in claim 14 wherein the mast track is configured to allow the mast to bend.

17. The method as claimed in claim 14 wherein each mast track section includes a beveled lower surface.

18. The method as claimed in claim 14 wherein the mast track sections are configured to allow longitudinal compression of the mast.

19. The method as claimed in claim 14 wherein adjacent mast track sections are separated by an interstitial space.

20. The method as claimed in claim 19 wherein adjacent mast track sections at the top of the mast are separated by smaller interstitial spaces than adjacent mast track sections at the bottom of the mast.

21. The method as claimed in claim 14 wherein the mast track is configured to allow for thermal expansion and contraction of the mast.

22. The method as claimed in claim 14 wherein the mast track sections are configured to pivot together along a common centerline parallel to the longitudinal axis of the mast.

23. claim 14 further comprising: providing a headboard car in the channel for sliding along an axis substantially parallel to the longitudinal axis of the mast.

24. The method as claimed in claim 14 wherein the mast track has a cross section comprising:

a batten guide formed of two substantially parallel batten guide arms;

a luff extrusion body having a luff rope slot formed forward of the batten guide, the luff rope slot being substantially parallel to a longitudinal axis of the mast; and a luff passage connecting the batten guide and the luff rope slot.

25. The method as claimed in claim 14 wherein the mast track is configured to coupled to an articulating sail feeder.

26. The method as claimed in claim 14 wherein the mast track is configured to be coupled to an articulating sail feeder, the articulating sail feeder comprising:

hinge tracks arranged in an articulated column with a longitudinal axis substantially parallel to a mast of a yacht, the hinge tracks configured to receive a luff of a sail, and the articulated column enabling lateral and rotational movement of a sail of the yacht;

limiting pins, each limiting pin disposed between a respective pair of adjacent hinge tracks, the limiting pins configured to limit movement of a given hinge track with respect to neighboring hinge track; and plural ball joints, each ball joint disposed between a respective pair of hinge adjacent tracks, the ball joints configured to receive a compression rod running through ball joints along the longitudinal axis of the articulated column.

* * * * *